US009118999B2

(12) United States Patent
Davis et al.

(10) Patent No.: US 9,118,999 B2
(45) Date of Patent: Aug. 25, 2015

(54) EQUALIZATION OF SPEAKER ARRAYS

(75) Inventors: Mark F. Davis, Pacifica, CA (US); Louise D. Fielder, Millbrae, CA (US); Nicolas R. Tsingos, Palo Alto, CA (US); Charles Q. Robinson, Piedmont, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 136 days.

(21) Appl. No.: 14/126,070

(22) PCT Filed: Jun. 27, 2012

(86) PCT No.: PCT/US2012/044338

§ 371 (c)(1), (2), (4) Date: Dec. 13, 2013

(87) PCT Pub. No.: WO2013/006323

PCT Pub. Date: Jan. 10, 2013

(65) Prior Publication Data

US 2014/0119570 A1 May 1, 2014

Related U.S. Application Data

(60) Provisional application No. 61/504,005, filed on Jul. 1, 2011, provisional application No. 61/636,076, filed on Apr. 20, 2012.

(51) Int. Cl.

| | |
|---|---|
| ***H04R 29/00*** | (2006.01) |
| ***H04R 5/00*** | (2006.01) |
| ***H04R 5/02*** | (2006.01) |
| ***H04R 3/12*** | (2006.01) |
| ***H04R 27/00*** | (2006.01) |
| ***H04S 7/00*** | (2006.01) |

(52) U.S. Cl.

CPC ..... *H04R 3/12* (2013.01); *H04R 27/00* (2013.01); *H04R 29/002* (2013.01); *H04R 29/007* (2013.01); *H04S 7/301* (2013.01); *H04R 5/02* (2013.01)

(58) Field of Classification Search

None

See application file for complete search history.

(56) References Cited

U.S. PATENT DOCUMENTS

| | | | | |
|---|---|---|---|---|
| 4,230,905 | A * | 10/1980 | Crum et al. | 381/300 |
| 4,984,273 | A | 1/1991 | Aylward | |
| 5,511,129 | A | 4/1996 | Craven | |
| 6,721,428 | B1 | 4/2004 | Allred | |
| 6,807,229 | B1 | 10/2004 | Kim | |
| 7,321,913 | B2 | 1/2008 | McGrath | |

(Continued)

FOREIGN PATENT DOCUMENTS

| | | |
|---|---|---|
| DE | 19612981 | 11/1996 |
| EP | 1600941 | 4/2010 |

(Continued)

OTHER PUBLICATIONS

Guillaume, M. et al, "Iterative Algorithms for Multichannel Equalization in Sound Reproduction Systems," IEEE International Conference on Acoustics, Speech and Signal Processing, pp. 269-272, vol. 3, 2005.

(Continued)

*Primary Examiner* — Andrew L Sniezek

(57) ABSTRACT

Methods and apparatus are described by which equalization and/or bass management of speakers in a sound reproduction system may be accomplished.

17 Claims, 4 Drawing Sheets

(56) References Cited

U.S. PATENT DOCUMENTS

| | | | | |
|---|---|---|---|---|
| 7,519,189 | B2 | 4/2009 | Bongiovi | |
| 7,548,598 | B2 | 6/2009 | Nieto | |
| 7,664,276 | B2 | 2/2010 | McKee Cooper | |
| 7,693,922 | B2 | 4/2010 | Schill | |
| 7,970,153 | B2 | 6/2011 | Konagai | |
| 8,082,051 | B2 | 12/2011 | Mihelich | |
| 2006/0062397 | A1* | 3/2006 | Cooper | 381/58 |
| 2007/0025559 | A1 | 2/2007 | Mihelich | |
| 2007/0058820 | A1 | 3/2007 | Sawara | |
| 2010/0067331 | A1 | 3/2010 | Yang | |
| 2011/0112664 | A1* | 5/2011 | Ong | 700/94 |
| 2014/0086437 | A1* | 3/2014 | Koh et al. | 381/307 |

FOREIGN PATENT DOCUMENTS

| | | |
|---|---|---|
| EP | 1843635 | 12/2010 |
| JP | 2004-531125 | 10/2004 |
| RS | 1332 U | 8/2013 |
| WO | 02/078388 | 10/2002 |

OTHER PUBLICATIONS

"Motion-Pictures—Dubbing Theaters, Review Rooms, and Indoor Theaters—B-Chain Electroacoustic Response," SMPTE Standard, 1998.

"For Motion-Pictures—Dubbing Stages (Mixing Rooms), Screening Rooms and Indoor Theaters—B-Chain Electroacoustic Response," SMPTE Standard, 2010.

Allen, I., The X-Curve: Its Origins and History: Electro-Acoustic Characteristics in the Cinema and the Mix-Room, the Large Room and the Small, SMPTE Motion Imaging Journal, Jul./Aug. 2006.

Stanojevic, T. et al "The Total Surround Sound System", 86th AES Convention, Hamburg, Mar. 7-10, 1989.

Stanojevic, T. et al "Designing of TSS Halls" 13th International Congress on Acoustics, Yugoslavia, 1989.

Stanojevic, T. et al "TSS System and Live Performance Sound" 88th AES Convention, Montreux, Mar. 13-16, 1990.

Stanojevic, Tomislav "3-D Sound in Future HDTV Projection Systems" presented at the 132nd SMPTE Technical Conference, Jacob K. Javits Convention Center, New York City, Oct. 13-17, 1990.

Stanojevic, T. "Some Technical Possibilities of Using the Total Surround Sound Concept in the Motion Picture Technology", 133rd SMPTE Technical Conference and Equipment Exhibit, Los Angeles Convention Center, Los Angeles, California, Oct. 26-29, 1991.

Stanojevic, T. et al. "TSS Processor" 135th SMPTE Technical Conference, Oct. 29-Nov. 2, 1993, Los Angeles Convention Center, Los Angeles, California, Society of Motion Picture and Television Engineers.

Stanojevic, Tomislav, "Virtual Sound Sources in the Total Surround Sound System" Proc. 137th SMPTE Technical Conference and World Media Expo, Sep. 6-9, 1995, New Orleans Convention Center, New Orleans, Louisiana.

Stanojevic, T. et al "The Total Surround Sound (TSS) Processor" SMPTE Journal, Nov. 1994.

Stanojevic, Tomislav "Surround Sound for a New Generation of Theaters, Sound and Video Contractor" Dec. 20, 1995.

* cited by examiner

EQUALIZATION OF SPEAKER ARRAYS

CROSS-REFERENCE OF RELATED APPLICATIONS

This application claims priority to U.S. Provisional Application No. 61/504,005 filed 1 Jul. 2011 and U.S. Provisional Application No. 61/636,076 filed 20 Apr. 2012, both of which are hereby incorporated by reference in entirety for all purposes.

TECHNOLOGY

The present application relates to signal processing. More specifically, embodiments of the present invention relate to equalization of speakers and speaker arrays.

BACKGROUND

Techniques for creating content for cinema involve mixing digital audio signals to generate a digital audio soundtrack for presentation in combination with the visual component(s) of the overall cinematic presentation. Portions of the mixed audio signals are assigned to and played back over a specific number of predefined channels, e.g., 6 in the case of Dolby Digital 5.1 and 8 in the case of Dolby Surround 7.1, both industry standards. An example of a Dolby Surround 7.1 sound reproduction system is shown in FIG. 1.

In this example, the sound reproduction system includes 16 speakers for reproducing the mixed audio over 8 channels. The speakers behind the screen correspond to the left (L), center (C), right (R), and low frequency effects (LFE) channels. Four surround channels deliver sound from behind and to the sides of the listening environment; left side surround (Lss), left rear surround (Lrs), right rear surround (Rrs), and right side surround (Rss). In a cinema environment, each of the surround channels typically includes multiple speakers (3 are shown in this example) referred to as an array. Each of the speakers in an array is driven by the same signal, e.g., all 3 of the Lss speakers receive the same Lss channel signal.

Setting up such a system for playback in a particular room typically involves adjusting the frequency response of the set of speaker(s) for each channel to conform to a predefined reference. This is accomplished by driving each channel's speakers with a reference signal (e.g., a sequence of tones or noise), capturing the acoustic energy with one or more microphones (not shown) located in the room, feeding the captured energy back to a sound processor, and adjusting the frequency response for the corresponding channel at the sound processor to arrive at the desired response.

This equalization might be done, for example, according to standards promulgated by The Society of Motion Picture and Television Engineers (SMPTE) such as, for example, *SMPTE Standard* 202*M*-1998 *for Motion-Pictures—Dubbing Theaters, Review Rooms, and Indoor Theaters—B-Chain Electroacoustic Response* (©1998) or *SMPTE Standard* 202:2010 *for Motion-Pictures—Dubbing Stages* (*Mixing Rooms*), *Screening Rooms and Indoor Theaters—B-Chain Electroacoustic Response* (©2010), a copy of the latter of which is attached hereto as an appendix and forms part of this disclosure.

SUMMARY

According to various embodiments, methods, systems, devices, apparatus, and computer readable-media are provided for equalizing the speakers of a sound reproduction system. According to a first class of embodiments, the speakers are configured in a plurality of arrays in a listening environment, each array including a subset of the speakers. An individual frequency response is determined for each of the speakers. Individual speaker equalization coefficients are determined for each of the speakers with reference to the corresponding individual frequency response and a speaker reference frequency response. An array frequency response is determined for each of the arrays, including modifying a stimulus applied to each of the speakers in each of the arrays using the corresponding individual speaker equalization coefficients. Array correction equalization coefficients are determined for each of the arrays with reference to the corresponding array frequency response and an array reference frequency response.

According to a specific embodiment, the sound reproduction system further includes one or more sub-woofers in the listening environment; each of the speakers being assigned a subset of the one or more sub-woofers to which low-frequency energy associated with the speaker below a cut-off frequency is to be directed. Determining the individual frequency responses and the array frequency responses includes directing low-frequency energy for each of the speakers to the assigned one or more sub-woofers. According to a more specific embodiment, the low-frequency energy for each of the speakers is apportioned among the assigned one or more sub-woofers with reference to one or more distances between the speaker and each of the assigned one or more sub-woofers.

According to a specific embodiment, a first one of the speakers is driven with a first audio signal in a first playback mode independent of a first one of the arrays that includes the first speaker, including using the individual speaker equalization coefficients associated with the first one of the speakers to modify frequency content of the first audio signal. All of the speakers in the first array are driven with a second audio signal in a second playback mode substantially simultaneous with the first playback mode, including using the individual speaker equalization coefficients associated with the speakers in the first array and the array correction equalization coefficients associated with the first array to modify frequency content of the second audio signal. According to a more specific embodiment, the sound reproduction system further includes one or more sub-woofers in the listening environment, each of the speakers being assigned a subset of the one or more sub-woofers. Driving the first one of the speakers with the first audio signal and driving all of the speakers of the first array with the second audio signal includes apportioning low-frequency energy for each of the speakers among the assigned one or more sub-woofers with reference to one or more distances between the speaker and each of the assigned one or more sub-woofers.

According to a more specific embodiment, the first audio signal is represented by a digital object that specifies a virtual trajectory of a discrete sound in a virtual environment representing the listening environment. A subset of the speakers including the first speaker is determined to drive with the one or more power amplifiers in the first playback mode to render the discrete sound to achieve an apparent trajectory in the listening environment corresponding to the virtual trajectory.

According to another class of embodiments, methods, systems, devices, apparatus, and computer readable-media are provided for implementing bass management for a sound reproduction system including a plurality of speakers and one or more sub-woofers. Each of the speakers is assigned a subset of the one or more sub-woofers to which low-frequency energy associated with the speaker below a cut-off frequency is to be directed. A portion of the associated low-frequency energy to be directed to each of the assigned one or more sub-woofers is determined with reference to one or more distances between the speaker and each of the assigned one or more sub-woofers.

According to a specific embodiment, the sub-woofers are assigned to each speaker based on a spatial relationship with the speaker.

According to a specific embodiment, a particular sub-woofer is excluded from the subset of sub-woofers assigned to a particular speaker where the determined portion of the low-frequency energy associated with the particular speaker to be directed to the particular sub-woofer is below a threshold.

According to a specific embodiment, the portion of the low-frequency energy associated with a particular speaker to be directed to a particular one of the assigned sub-woofers is determined with reference to an exponential power of a Euclidean distance between the particular speaker and the particular assigned sub-woofer.

According to a specific embodiment, one or more distances is determined for each of the speakers between the speaker and each of the assigned sub-woofers with reference to a room configuration file representing a listening environment in which the speakers and sub-woofers are deployed.

According to specific embodiments, the subset of sub-woofers assigned to a particular one of the speakers includes all or fewer than all of the sub-woofers of the sound reproduction system.

According to a specific embodiment, the low-frequency energy associated with a particular speaker is apportioned among its assigned sub-woofers and, the sub-woofers assigned to the particular speaker are driven with the apportioned low-frequency energy such that resulting acoustic energy appears to be originating from a location in the listening environment near the particular speaker.

According to a specific embodiment of any of the previously described embodiments, the sound reproduction system employs a digital audio format having a plurality of channels, and wherein each of the arrays corresponds to one of the channels.

A further understanding of the nature and advantages of the present invention may be realized by reference to the remaining portions of the specification and the drawings.

DESCRIPTION OF EXAMPLE EMBODIMENTS

Reference will now be made in detail to specific embodiments of the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims. In the following description, specific details are set forth in order to provide a thorough understanding of the present invention. The present invention may be practiced without some or all of these specific details. In addition, well known features may not have been described in detail to avoid unnecessarily obscuring the invention.

Techniques are described by which equalization of speakers in a sound reproduction system may be accomplished that are particularly advantageous for systems having increasing numbers of channels and increasingly sophisticated modes of sound reproduction.

Figure 1:
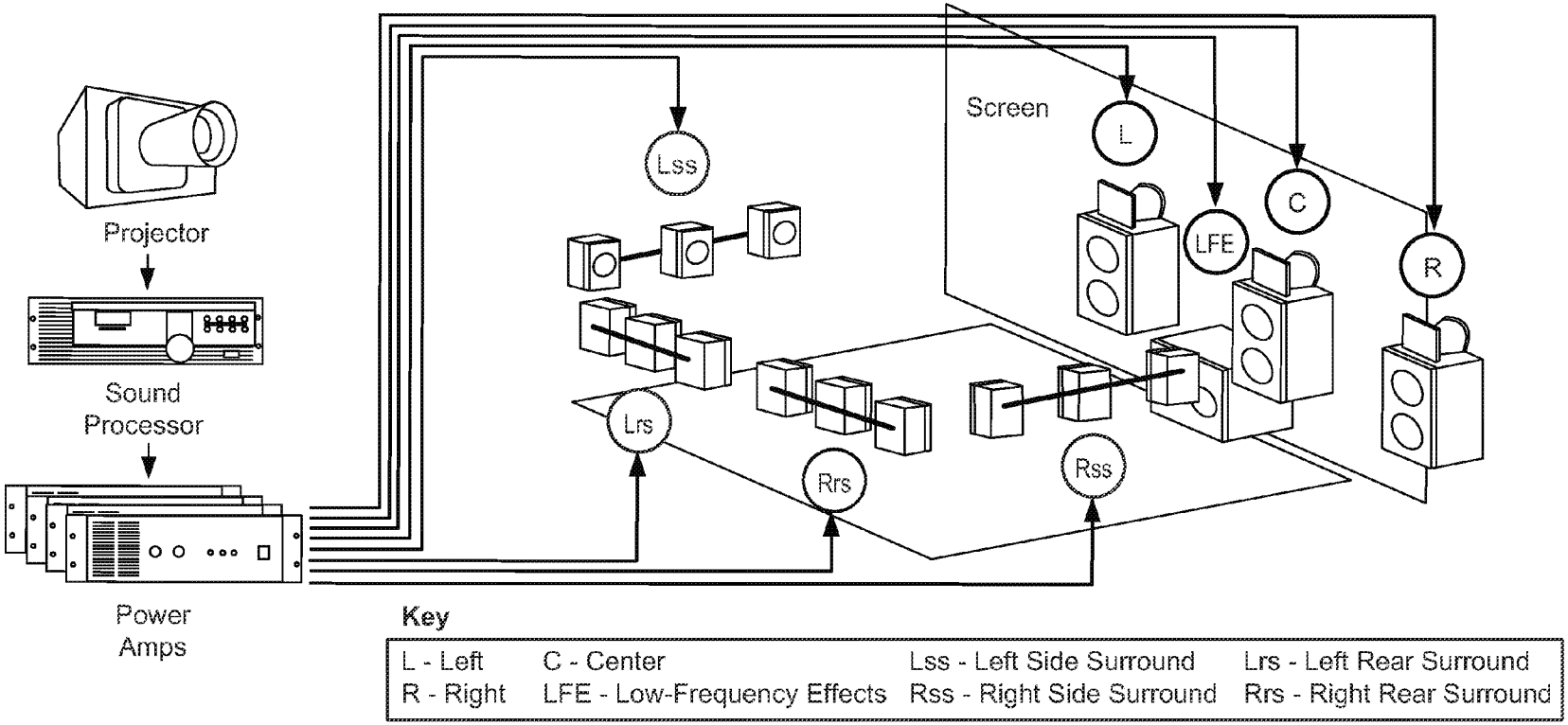
FIG. 1 is a simplified diagram of an example of a multi-channel digital audio reproduction system.
Figure 2:
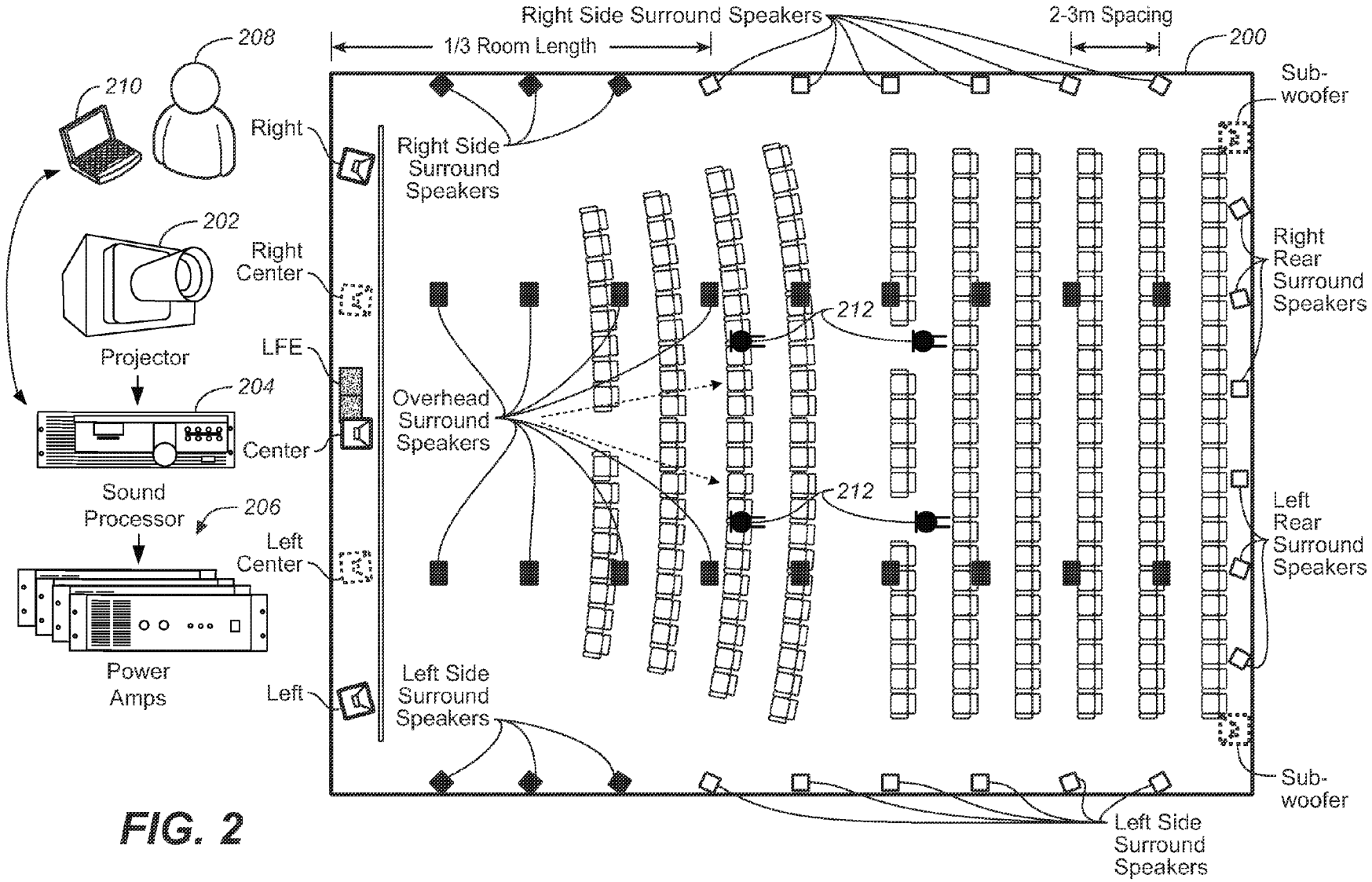
FIG. 2 is a simplified diagram of another example of a multi-channel digital audio reproduction system.

FIG. 2 shows an example of a cinema environment 200 (viewed from overhead) in which a particular implementation may be practiced. A projector 202, a sound processor 204, and a bank of audio power amplifiers 206 operate cooperatively to provide the visual and audio components of the cinematic presentation, with power amplifiers 206 driving speakers and sub-woofers deployed around the environment (connections not shown for clarity). Sound processor 204 may be any of a variety of computing devices or sound processors including, for example, one or more personal computers or one or more servers, or one or more cinema processors such as, for example, the Dolby Digital Cinema Processor CP750 from Dolby Laboratories, Inc. Interaction with sound processor 204 by a sound engineer 208 might done through a laptop 210, a tablet, a smart phone, etc., via, for example, a browser-based html connection. The measurement and processing will typically be done with the sound processor which includes analog or digital inputs to receive microphone feeds, as well as outputs to drive the speakers.

The depicted environment includes overhead speakers and can be configured by the sound processor to playback soundtracks having different numbers of audio channels (e.g., 6, 8, 10, 14, etc.), with different subsets of the speakers corresponding to the different channels. Sound processor 204 may be configured to drive each subset or array of speakers (via power amplifiers 206) with the mixed audio for the corresponding channel in accordance with any of a variety of digital audio formats (e.g., Dolby 5.1 or 7.1, or formats having greater numbers of channels, e.g., 9.1, 13.1, or higher).

Sound processor 204 may also be configured to exercise substantially simultaneously with the mixed audio channel playback a more granular control over various subsets of speakers in the listening environment to render a realistic three-dimensional virtual sound environment in which discrete sounds appear to originate at specific points in the environment, and to move about the environment with realistic trajectories that correspond to the visual presentation. That is, sound processor 204 is configured to drive individual speakers or combinations of individual speakers independently of and substantially simultaneously with the mixed audio of the various channels to achieve such effects. This may be done, for example, using sound objects that specify such discrete sounds in a virtual three-dimensional environment that corresponds to the physical listening environment. According to a particular class of such implementations, the physical arrangement of the speakers and sub-woofers is specified in a room configuration file (e.g., using any appropriate two or three-dimensional coordinate system) available to the sound processor which translates the specification of a sound object to a set of speakers to be driven along with the appropriate gains to achieve the desired apparent location and/or movement trajectory of the sound during rendering.

According to a specific implementation, sound processor 204 is configured to adjust for the frequency responses of the speakers in the listening environment in a two-tiered equalization process. As will be discussed, the first tier equalizes each individual speaker to a specified target frequency response, and the second tier then equalizes speakers grouped into arrays with the first-tier equalization in place. A particular implementation of an acquisition process by which equalization coefficients are generated is illustrated in FIG. 3.

Figure 3:
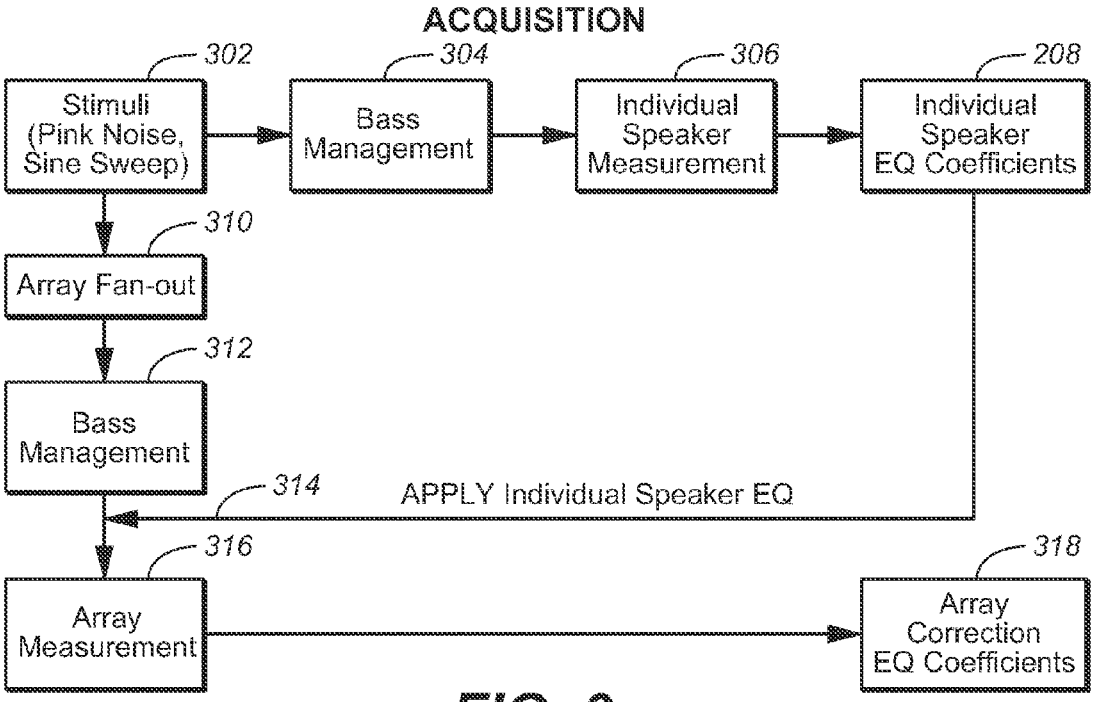
FIG. 3 is a flow diagram of a technique for acquiring equalization coefficients.

The equalization process depicted in FIG. 3 is conducted as part of the setup process by which a sound reproduction system such as the one depicted in FIG. 2 is configured for a particular listening environment, and may be conducted using one or more sound processors such as, for example, sound processor 204. The equalization process is performed when the sound reproduction system is first deployed by a sound engineer (e.g., engineer 208) via an interface to the sound processor (e.g., using laptop 210). And as will be understood, the process may also be performed at any time later, e.g., periodically (even daily) to adjust the equalizations to account for any modifications to the listening environment or changes in the speaker and sub-woofer frequency responses. To facilitate the process, an array of microphones 212 is deployed in the listening environment to provide feedback to the sound processor for measuring the frequency responses of the various individual speakers and arrays (connections not shown for clarity).

According to various implementations, the acoustic energy captured by the microphones may be processed in a variety of ways. For example, the energy captured by the microphones may be averaged to ensure that an accurate representation of the energy (e.g., one less affected by various modes of the room) is used. According to some implementations, only particular microphones might be used to acquire the acoustic energy for specific subsets of the speakers. Alternatively or in addition, the contributions from different microphones might be weighted depending on their locations. Other suitable variations will be apparent to those of skill in the art.

The first tier of equalizations is illustrated across the top of the flow diagram of FIG. 3 from left to right and is performed for each speaker in the listening environment. Each speaker is individually driven with a stimulus (302), e.g., pink noise, a sine sweep, etc. An optional bass management step (304) determines the amount (between 0 and 100%) of the low frequency energy of the drive signal for each speaker to redirect to one or more of the sub-woofers located around the listening environment (typically, but not necessarily, the nearest one). Further details of a bass management process by which these amounts may be determined are discussed below.

Acoustic energy resulting from the stimulus applied is captured (e.g., with the microphone(s)) and measured by the sound processor for each individual speaker (306). According to a particular implementation, this involves generating values at logarithmically spaced points (e.g., 200 points) distributed over the audio spectrum (e.g., 0-20 kHz).

According to a more specific implementation, 20 seconds of pink noise is used as the default stimulus and the resulting 20 seconds of measurement data is averaged using a running Fast Fourier Transform (FFT) of approximately 2.7 seconds duration, resulting in approximately 131,000 frequency data points. This enables a very fine resolution even at low frequencies. The approximately 131,000 data points are binned into some much lower number of data points (e.g., 200) that will be used in the comparison with the reference response. As will be understood, such an approach allows for greater or lesser resolution in the measured frequency response depending on the application. In addition to being faster than a direct, point-by-point spectral measurement using a multi-band filter, this approach also readily derives the impulse response of the speaker which would not be as readily obtainable using a point-by-point spectral measurement.

The sound processor then calculates filter coefficients, also referred to herein as "equalization coefficients," for each individual speaker (or speaker/sub-woofer combination) by comparing the frequency response of the captured acoustic energy with a desired reference (e.g., from an "X-Curve" family), and selecting coefficients for a digital filter to modify the frequency content of the input to the speaker so as to minimize the difference between the frequency response of the speaker and the reference response (308). Tolerances for this difference may vary for particular applications. The desired reference response may be the same for each speaker. Alternatively, different reference responses may be used for different speakers, e.g., to account for different types of speakers having different operational characteristics.

The X-Curve is described in *The X-Curve* by Ioan Allen, *SMPTE Motion Imaging Journal*, July/August 2006, a copy of which is attached hereto as an appendix and forms part of this disclosure. It should be understood, however, that a wide variety of other references may be used. It should also be noted that, where the equalization coefficients are determined for a particular speaker/sub-woofer combination, equalization coefficients for each of the sub-woofers might be determined in separate operations (not shown) prior to the determination of the equalization coefficients for the various speaker/sub-woofer combinations.

According to a particular implementation, the filter for which the equalization coefficients are generated is a $1/12^{th}$ octave band resolution filter implemented as a multi-rate finite impulse response filter. Examples of filter implementations and coefficient calculations suitable for use with embodiments of the invention are described in U.S. Pat. No. 7,321,913 for Digital Multirate Filtering issued on Jan. 22, 2008, a copy of which is attached hereto as an appendix and forms part of this disclosure. Those of skill in the art will also understand the wide variety of alternatives that may be employed. For example, filter implementations such as those described in the '913 patent may require more processing resources than are desirable or available in some applications (e.g., consumer applications). Such applications might therefore use more efficient filter implementations (in terms of processing resources) such as, for example, biquad filters or other suitable alternatives.

In some implementations, the equalization of a particular speaker may be limited with reference to the frequency range of operation for that speaker type (e.g., as specified in the room configuration file). Thus, a nominal equalization determined for a speaker may be further limited to ignore frequency bands outside of that speaker's operating range. For example, there is no point in attempting to boost a high frequency speaker such as a tweeter by 100 dB at 20 Hz.

The amount by which an equalization may boost or cut the drive for a particular speaker at a particular frequency in the operating range of that speaker may also be limited. For example, allowing boost above a certain amount may result in clipping of signals by the sound processor even though such a boost level might be required for the frequency response of a speaker to match the reference response. To avoid this, the nominal equalization may be limited to ensure that the boost or cut at any particular frequency does not exceed some programmable threshold. As will be understood, such limits may result in a difference between the speaker's response and the desired reference response, but may be an acceptable compromise when compared against the effects of clipping.

Once the equalization coefficients for the individual speakers (the "individual speaker equalization coefficients") have been determined, equalization coefficients for each array of speakers (also referred to herein as "array correction equalization coefficients") are then determined. This is represented by the flow down the left side of the diagram of FIG. 3. It should be noted that an array of speakers may be any arbitrarily defined subset of the speakers in the listening environment. However, it may be advantageous in some applications to define the arrays to correspond to the various channels of the digital audio format in which the mixed audio is represented, e.g., Dolby 5.1 or 7.1, formats with higher numbers of channels, etc.

The stimulus (302), which may or may not be the same stimulus as applied before, is duplicated to each speaker in the array being equalized according to the array fanout (310) which specifies which speakers belong to which array. The array fanout may also include an energy preserving scaling of the array input to each of the speakers in the array (e.g., by the inverse of the square root of the number of speakers) to ensure that a consistent sound pressure level is reached regardless of the number of speakers in a particular array. Again, bass management (312) may be optionally applied to redirect a portion of the acoustic energy for each speaker in the array to its assigned sub-woofer(s).

The stimulus is then filtered using the previously derived equalization coefficients for the individual speakers before it is applied to the corresponding speakers (and potentially sub-woofers) of the array (314). The capture and measurement of the acoustic energy of the array (316) is done with a microphone array in a manner similar to that described above with reference to generation of the individual speaker coefficients. Ideally, the effect of filtering using just the individual speaker coefficients would result in a frequency response of the array which is at or near the desired reference. However, effects such as bass build-up and room acoustics can cause deviations which are corrected by filtering using array correction equalization coefficients.

As with the process for individual speakers, these coefficients are determined by comparing the frequency response of the captured acoustic energy with a desired reference response and selecting coefficients for a digital filter that will modify the frequency content of the input to the array so as to minimize the difference between the frequency response of the array and the reference (318). It should be noted that, while some applications may employ the same reference or family of references for determining both the individual and array coefficients, implementations are contemplated in which different references may be employed as between individual speakers, between speakers and arrays, and between different arrays. In addition, while the same filter implementation may be used for both individual and array equalization, it should be noted that different filters might also be employed.

According to some implementations, verification of a determined equalization may be performed. That is, once equalization coefficients have been determined for a particular speaker, speaker/sub-woofer combination, array, etc., another measurement of the corresponding response may be conducted using the corresponding equalization, which is then compared to the reference response to ensure that the determined equalization actually results in a match with the reference response.

According to a particular implementation that employs a bass management scheme, the frequency responses of the individual speakers during the first tier of equalization is determined without redirecting energy to corresponding sub-woofers (the responses for which are determined separately). However, for the second tier of equalization as well as during playback, the sound energy directed to a particular speaker is split between that speaker and its corresponding sub-woofer using a cross-over (e.g., a Linkwitz-Riley $4^{th}$ order cross-over or other suitable alternative). Because the frequency responses of the individual speakers and the corresponding sub-woofers were not equalized as a unit in the first tier of equalization, the frequency response of the cross-over is taken into account during the second tier of equalization to ensure the resulting measurement of the array frequency response accounts for the effect of the cross-over when determining filter coefficients for playback. That is, while the individual equalizations of a speaker and its corresponding sub-woofer may be assumed to work together as a unit to achieve the desired response without explicitly accounting for the cross-over, this may not necessarily be assumed for an entire array, and thus the effect of the crossover may be taken into account during array equalization.

According to alternative implementations, and as mentioned elsewhere herein, the first tier of equalization may be performed with bass management in place so that the responses of individual speaker/sub-woofer combinations are measured as a unit, with the effect of the cross-over being inherent in the measured response. This could be done during an initial equalization pass, or after the individual responses for the speakers and sub-woofers have been measured and equalized (in a subsequent base-managed measurement and equalization for the individual speaker/sub-woofer combinations) to ensure the combined corrected responses operate as expected.

By applying equalizations for both individual speakers and arrays of speakers for different, substantially simultaneous playback modes, the techniques described herein allow for faithful reproduction of sound when the different playback modes are combined. That is, for example, when an individual speaker is driven (e.g., as a point source of sound), that speaker's individual equalization is applied to the drive signal to ensure the optimal playback for that particular speaker. However, when an array of speakers is driven together (e.g., as part of an ambient background or soundtrack), the array's equalization is applied to the drive signal (in addition to the equalizations for the individual speakers in the array) to ensure the optimal playback for the array. This avoids artifacts that might occur for an array if only the individual equalizations were used (e.g., undesirable bass boost). It also allows for timbral matching between the acoustic energy being reproduced in the two different modes, e.g., between the acoustic energy resulting from a speaker driven as a point source, and acoustic energy resulting from that same speaker being driven as part of an array.

Figure 4:
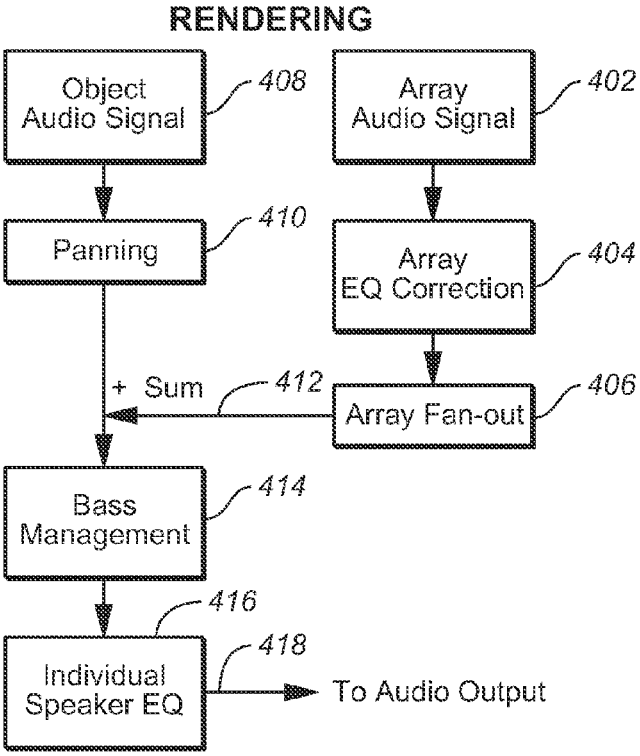
FIG. 4 is a flow diagram of a technique for rendering digital audio using equalization coefficients.

A particular implementation of a rendering process that uses equalizations such as those described above with reference to FIG. 3 is illustrated in FIG. 4. The rendering process may be conducted using one or more sound processors such as, for example, processor 204 of FIG. 2. Two different modes of audio playback are represented in the depicted rendering process by an object audio signal source and an array audio signal source. The rendering of the two different signal sources by the sound processor and power amplifiers occurs substantially simultaneously over the speakers. An array audio signal might correspond, for example, to a particular channel of a multi-channel digital audio format, while an object audio signal might correspond to a discrete sound to be simultaneously rendered with the ambient soundtrack represented by the various channels. When the source is an array audio signal (402), the signal is filtered using the previously calculated array correction equalization coefficients for the array to which the signal is directed (404), and the signal duplicated and scaled according to the array fan-out for the corresponding array (406).

The object audio signal (408) is subjected to a panning operation (410) (which may be thought of as a dynamic analog of the array fan-out operation) which determines from the object's specification and the room configuration file which speakers are to be driven and the gain to be applied for each to achieve the intended effect represented by the object (e.g., to place a point source of sound at a particular apparent location in the listening environment). This might result, for example, in only a subset of the speakers in a given array receiving this input. Such an object might also implicate speakers in other arrays (e.g., in the case of a sound moving around the listening environment), so the object audio signal may actually be interacting with multiple different array audio signals in a dynamic way. As with the fixed array fan-out, the panning operation is also energy preserving to ensure a consistent sound pressure level as, for example, a sound moves about the environment.

The object audio signal is then combined (412) with the corrected array audio signals for the speaker(s) in the particular array to which the object audio signal is also directed. Again, bass management (414) may be optionally applied to redirect a portion of the acoustic energy for each speaker to its assigned sub-woofer(s). The combined signals are then filtered using the individual speaker equalization coefficients (416) before being sent to the speakers of the array (via the power amplifiers) for rendering (418). As will be understood, the depicted process occurs substantially simultaneously for all of the active arrays in the system, the speakers in some of which may or may not also be simultaneously rendering one or more object audio signals at any given time.

One of the playback requirements for most cinematic environments is that sound from the front channels, e.g., the speakers behind the screen, reach the listener before corresponding sound from surround channels (e.g., side, rear or overhead channels). Cinema processors therefore typically delay the sound for the surround channels. According to some implementations, a conservative approach may be employed in which the delays are determined based on the room dimensions. According to other implementations, the delay from each speaker to the microphone(s) is measured when the frequency response for that speaker is being measured. This delay is then compared to the delay measured for one or more of the front channel speakers, e.g., the front center speaker, and this difference is used to select the appropriate delay for that speaker for playback.

According to one such implementation in which the frequency response of each speaker is determined using a running FFT as described above, the frequency response points generated in the frequency domain by the FFT are reverse-transformed back into the time domain to obtain a representation of the speaker's impulse response. The speaker's delay relative to a reference speaker, e.g., the front center speaker, is then determined by comparing the peaks of the respective time-domain impulse responses for those speakers.

According to various implementations, the equalization technique not only corrects for the measured frequency responses, but also attempts to match the loudness of the speakers. According to a particular implementation, this is accomplished by passing the measured response for each speaker through a mid-range filter (high and low frequencies may typically be neglected in loudness measurements) and calculating an average loudness for each speaker, which is then used to determine a gain correction relative to the measured loudness of a reference speaker, e.g., the front center speaker. This gain correction may also be used in the equalization of the arrays in which the corresponding speakers are included. Loudness gains for individual speakers may also be limited. This can be advantageous where, for example, a speaker is damaged or not operating efficiently and is therefore not generating the expected sound pressure level. If the allowable loudness gain is not limited, the determined gain for that speaker required to match the loudness levels of the other speakers in the system might result in an undesirable overdriving of the underperforming speaker.

As mentioned above, the bass management steps of the processes illustrated in FIGS. 3 and 4 involve the redirection of low-frequency energy of the drive signals from each of the speakers to one or more sub-woofers located around the listening environment. As with the array fan-out and panning operations described above, this may also be done in an energy preserving manner to achieve a consistent sound pressure level for a given number of speakers and sub-woofers. The sub-woofer(s) to which a particular speaker's low frequency energy is redirected may be arbitrarily assigned, for example, by the sound engineer setting up the system. Alternatively, this assignment may be done automatically by the sound processor based, for example, on the relative locations of each speaker and the various sub-woofers in the environment.

According to a particular implementation, the amount of the low frequency energy for each speaker that is redirected to the assigned sub-woofer(s) is determined with reference to the relative positions of the speaker and the sub-woofer(s) in the listening environment (e.g., as specified in the room configuration file). This may be understood with reference to the diagram in FIG. 5 which depicts an example of a physical arrangement of various arrays of speakers in a listening environment to five sub-woofers. In addition to assigning each of the speakers to specific sub-woofers, the audio engineer may also specify the cutoff frequency for the speakers (individually, by array, etc.) which is the frequency below which the signal energy would be redirected to the assigned sub-woofers. Alternatively, a default cutoff and/or automatic assignment of speakers to sub-woofers may be used.

Figure 5:
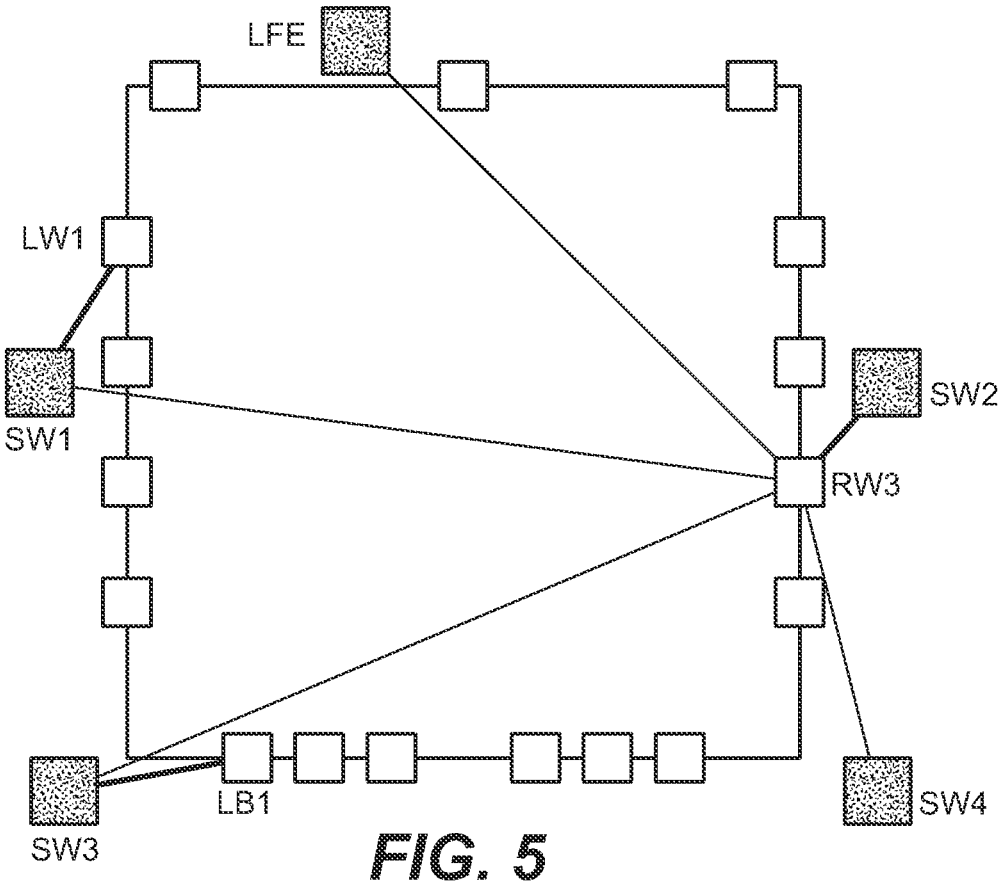
FIG. 5 is a simplified diagram of a listening environment in which a bass management technique is described.

Once the speakers have each been assigned to one or more sub-woofers and the cutoff frequency for each has been specified, the engineer may manually specify the distribution of each speaker's low-frequency energy among its assigned sub-woofer(s). For example, if only two additional sub-woofers were deployed in the listening environment, e.g., one on the left and one on the right, the engineer might specify that all or some portion of the low-frequency energy from each of the speakers on the left be redirected to the left sub-woofer, and all or some portion of the low-frequency energy from each of the speakers on the right be redirected to the right sub-woofer. For a more complicated arrangement, e.g., in which there are multiple additional sub-woofers deployed on each side of the environment as shown in FIG. 5, the engineer might specify different percentages of each speaker's energy going to different sub-woofers.

Manual specification might not be desirable where, for example, the number of speakers is large, or the arrangement of sub-woofers is complex. Therefore, according to a particular implementation, the sound processor (e.g., sound processor 204 of FIG. 2) uses the speaker and sub-woofer locations (e.g., as specified by the room configuration file) to automatically determine how much of each speaker's low frequency energy to redirect to the assigned sub-woofer(s). This distribution of low-frequency energy is then fixed for playback and/or the acquisition of equalization coefficients as described above. Determining the distribution may be done, for example, using simple ratios of the distances of a particular speaker from the sub-woofer(s) to which it has been assigned. Alternatively, more complicated calculations may use these distances. The basic concept may be understood with reference to FIG. 5 in which the bass management of speakers LW1, RW3 and LB1 among sub-woofers SW1-SW4 and the low-frequency effects (LFE) sub-woofer (e.g., behind the screen) is illustrated.

In this example, LW1 is bass managed by the LFE and SW1, LB1 is bass managed by SW3, and RW3 is base managed by all of the sub-woofers. As discussed above, these sub-woofer assignments might be based, for example, on an engineer's specification, or done automatically. The low-frequency energy of the signal fed to each speaker (e.g., the energy below the specified cut-off frequency) is redirected to the assigned sub-woofers based on the relative distances between the speaker and each sub-woofer according to a function d(speaker,sub), which can be based, for example, on the Euclidean distance between the speaker and sub-woofer locations, or a higher exponential power of that function (e.g., the square, the cube, etc.). In this example, the low-frequency energy below the cut-off from LB1 is redirected to SW3 with a gain of 1.0. By contrast, the low-frequency energy from RW3 is redirected to SW1 with a gain of 1/d(RW3, SW1), and to SW2 with a gain of 1/d(RW3, SW2). In addition, the gains may be normalized in an energy preserving step so that the sum (amplitude) or the sum of their squares (energy) is equal to 1.

The LFE signal driving the main sub-woofer behind the screen is typically boosted 10 dB relative to the other speakers in the system. Therefore, if low-frequency energy from the speakers distributed throughout the listening environment is being bass managed in a way that redirects some portion of their low-frequency energy to the main sub-woofer, the measurements of the bass managed contributions from these speakers to the main sub-woofer may be attenuated by 10 dB to account for this. More generally, bass management techniques described herein can be implemented to take into account and adjust for differences in calibration level gain for a speaker and its corresponding sub-woofer when measuring speaker and array frequency responses.

In some implementations, the distributions of low-frequency energy among assigned sub-woofers are intended to approximate simulation of the resulting low-frequency acoustic energy of a particular speaker originating at or near that speaker's location rather than the locations of the sub-woofers. However, other intended effects are contemplated. For example, bass management as described herein may be performed even where only one sub-woofer exists in the listening environment (e.g., the LFE channel sub-woofer). And as will be understood, the manner in which these percentages are calculated and the low-frequency energy distributed may vary considerably. For example, distribution of energy among three sub-woofers might employ a more complex geometry to simulate the intended effect or approximation. And as discussed above, the low-frequency energy from a particular speaker could be distributed among all of the sub-woofers distributed throughout the listening environment. Alternatively, the energy distribution for a particular speaker may be automatically or manually constrained to only a specific subset of sub-woofers, e.g., only those within a certain distance or in a particular quadrant or half of the room.

According to a particular implementation, the sound processor may be configured to prevent any low-frequency energy for a particular speaker from being redirected to a particular sub-woofer if the calculation yields a percentage below some programmable threshold. For example, if the amount of the redirected energy for a particular sub-woofer would be less than 10% of the total, the calculated percentages could be reset to any other assigned sub-woofers, e.g., from 60%, 32% and 8% divided among three sub-woofers to 66% and 34% divided among two.

Implementations of the bass management techniques described herein enable improved presentation of low-frequency effects out into the three dimensions of the listening environment. With fewer sub-woofers than the number of deployed surround speakers, such bass management capabilities allow the presentation of low-frequency effects as if they were being delivered by the full number of speakers. This, in turn allows for a more seamless transition of the timbre of sounds that appear to move from in front of the audience (e.g., with the acoustic energy coming from the speakers and LFE sub-woofer behind the screen) to locations within the 3-dimensional listening environment behind, over, and to the side of the audience. For example, the sound of a helicopter flying over the audience won't abruptly lose all of its bass as the sound moves to the back of the theater.

Equalization and bass management techniques implemented as described herein may be used to configure sound reproduction systems in a variety cinematic environments and computing contexts using any of a variety of sound formats. It should be understood therefore that the scope of the invention is not limited to any particular type of cinematic environment, sound format, sound processor, or computing device. In addition, the computer program instructions with which embodiments of the invention may be implemented may correspond to any of a wide variety of programming languages and software tools, and be stored in any type of volatile or nonvolatile, non-transitory computer-readable storage media or memory device(s), and may be executed according to a variety of computing models including, for example, a client/server model, a peer-to-peer model, on a stand-alone computing device, or according to a distributed computing model in which various of the functionalities described herein may be effected or employed at different locations. Therefore, references herein to particular functionalities being executed or conducted by a sound processor should be understood as being merely by way of example. As will be understood by those of skill in the art, the functionalities described herein may be executed or conducted by a wide variety of computing configurations without departing from the scope of the invention. Embodiments are also contemplated in which some or all of the described functionalities are implemented in one or more integrated circuits (e.g., an application specific integrated circuit or ASIC), a programmable logic device(s) (e.g., a field programmable gate array), a chip set, etc.

While the invention has been particularly shown and described with reference to specific embodiments thereof, it will be understood by those skilled in the art that changes in the form and details of the disclosed embodiments may be made without departing from the spirit or scope of the invention. For example, a specific implementation described above includes two tiers of equalization; a first for the individual speakers, and a second for each array of speakers. It should be noted that implementations are contemplated in which one or more additional tiers of equalization could be included, e.g., for progressively larger combinations of speakers and arrays, or for different, overlapping arrays.

In another example, bass management techniques as described herein may be implemented independently of the equalization techniques described herein. For example, such bass management techniques may be employed to enhance the listening experience in any listening environment in which the distribution of low-frequency acoustic energy among one or more sub-woofers may be desirable.

Finally, although various advantages, aspects, and objects of the present invention have been discussed herein with reference to various embodiments, it will be understood that the scope of the invention should not be limited by reference to such advantages, aspects, and objects. Rather, the scope of the invention should be determined with reference to the appended claims.

What is claimed is:

1. A computer-implemented method for use with a sound reproduction system including a plurality of speakers and one or more sub-woofers, the method comprising, for each of the speakers:

using one or more computing devices, assigning a subset of the one or more sub-woofers to which low-frequency energy associated with the speaker below a cut-off frequency is to be directed; and using the one or more computing devices, determining a portion of the associated low-frequency energy to be directed to each of the assigned one or more sub-woofers with reference to one or more distances between the speaker and each of the assigned one or more sub-woofers.

2. The method of claim 1 wherein the one or more sub-woofers are assigned to each speaker based on a spatial relationship with the speaker.

3. The method of claim 1 further comprising excluding a particular sub-woofer from the subset of sub-woofers assigned to a particular speaker where the determined portion of the low-frequency energy associated with the particular speaker to be directed to the particular sub-woofer is below a threshold.

4. The method of claim 1 wherein the portion of the low-frequency energy associated with a particular speaker to be directed to a particular one of the assigned sub-woofers is determined with reference to an exponential power of a Euclidean distance between the particular speaker and the particular assigned sub-woofer.

5. The method of claim 1 further comprising, for each of the speakers, determining the one or more distances between the speaker and each of the assigned sub-woofers with reference to a room configuration file representing a listening environment in which the speakers and sub-woofers are deployed.

6. The method of claim 1 wherein the subset of sub-woofers assigned to a particular one of the speakers includes all of the sub-woofers of the sound reproduction system.

7. The method of claim 1 wherein the subset of sub-woofers assigned to a particular one of the speakers includes fewer than all of the sub-woofers of the sound reproduction system.

8. The method of claim 1 wherein the speakers are configured in a plurality of arrays in a listening environment, each array comprising a subset of the speakers, the method further comprising:

using the one or more computing devices, determining an individual frequency response for each of the speakers;

using the one or more computing devices, determining individual speaker equalization coefficients for each of the speakers with reference to the corresponding individual frequency response and a speaker reference frequency response;

using the one or more computing devices, determining an array frequency response for each of the arrays, including modifying a stimulus applied to each of the speakers in each of the arrays using the corresponding individual speaker equalization coefficients; wherein determining the individual frequency responses and the array frequency responses includes directing low-frequency energy for each of the speakers to the assigned subset of one or more sub-woofers; and using the one or more computing devices, determining array correction equalization coefficients for each of the arrays with reference to the corresponding array frequency response and an array reference frequency response.

9. The method of claim 8, further comprising:

driving a first one of the speakers with a first audio signal in a first playback mode independent of a first one of the arrays that includes the first speaker, including using the individual speaker equalization coefficients associated with the first one of the speakers to modify frequency content of the first audio signal; and driving all of the speakers in the first array with a second audio signal in a second playback mode substantially simultaneous with the first playback mode, including using the individual speaker equalization coefficients associated with the speakers in the first array and the array correction equalization coefficients associated with the first array to modify frequency content of the second audio signal.

10. The method of claim 8 wherein the sound reproduction system employs a digital audio format having a plurality of channels, and wherein each of the arrays corresponds to one of the channels.

11. A computer program product comprising one or more non-transitory computer-readable media having computer program instructions stored therein, the computer program instructions being configured, when executed, to cause one or more computing devices to perform the method of claim 1.

12. A sound processing system for use with a sound reproduction system including a plurality of speakers and plurality of sub-woofers, the sound processing system comprising one or more computing devices configured to, for each of the speakers:

assign a subset of the sub-woofers to which low-frequency energy associated with the speaker below a cut-off frequency is to be directed; and determine a portion of the associated low-frequency energy to be directed to each of the assigned sub-woofers with reference to one or more distances between the speaker and each of the assigned sub-woofers.

13. The system of claim 12 wherein the sound reproduction system further includes one or more power amplifiers, and the speakers and the sub-woofers are deployed in a listening environment, and wherein the one or more computing devices are configured to apportion the low-frequency energy associated with a particular speaker among its assigned sub-woofers and, in conjunction with the one or more power amplifiers, drive the sub-woofers assigned to the particular speaker with the apportioned low-frequency energy such that resulting acoustic energy appears to be originating from a location in the listening environment near the particular speaker.

14. The system of claim 12 wherein the speakers are configured in a plurality of arrays in a listening environment, each array comprising a subset of the speakers, wherein the one or more computing devices are configured to:

determine an individual frequency response for each of the speakers;

determine individual speaker equalization coefficients for each of the speakers with reference to the corresponding individual frequency response and a speaker reference frequency response;

determine an array frequency response for each of the arrays, including modifying a stimulus applied to each of the speakers in each of the arrays using the corresponding individual speaker equalization coefficients; wherein the individual frequency responses and the array frequency responses are determined by apportioning the low-frequency energy for each of the speakers among the assigned sub-woofers with reference to one or more distances between the speaker and each of the assigned sub-woofers; and determine array correction equalization coefficients for each of the arrays with reference to the corresponding array frequency response and an array reference frequency response.

15. The sound processing system of claim 14 further comprising one or more power amplifiers, the one or more computing devices being further configured in combination with the one or more power amplifiers to:

in a first playback mode, drive a first one of the speakers with a first audio signal independent of a first one of the arrays that includes the first speaker, including using the associated individual speaker equalization coefficients to modify frequency content of the first audio signal; and in a second playback mode substantially simultaneous with the first playback mode, drive all of the speakers in the first array with a second audio signal including using the associated array correction equalization coefficients and the associated individual speaker equalization coefficients to modify frequency content of the second audio signal.

16. The sound processing system of claim 14 wherein the first audio signal is represented by a digital object that specifies a virtual trajectory of a discrete sound in a virtual environment representing the listening environment, the one or more computing devices being further configured to determine a subset of the speakers including the first speaker to drive with the one or more power amplifiers in the first playback mode to render the discrete sound to achieve an apparent trajectory in the listening environment corresponding to the virtual trajectory.

17. The sound processing system of claim 14 wherein the sound reproduction system employs a digital audio format having a plurality of channels, and wherein each of the arrays corresponds to one of the channels.

* * * * *

UNITED STATES PATENT AND TRADEMARK OFFICE

CERTIFICATE OF CORRECTION

PATENT NO. : 9,118,999 B2
APPLICATION NO. : 14/126070
DATED : August 25, 2015
INVENTOR(S) : Mark F. Davis et al.

It is certified that error appears in the above-identified patent and that said Letters Patent is hereby corrected as shown below:

In the Title page:

(75) Inventors:
The second named inventor should be Louis D. Fielder and not Louise D. Fielder.

Signed and Sealed this
Nineteenth Day of January, 2016

Michelle K. Lee

Michelle K. Lee
*Director of the United States Patent and Trademark Office*